US009211709B2

(12) United States Patent
Yamashita et al.

(10) Patent No.: US 9,211,709 B2
(45) Date of Patent: Dec. 15, 2015

(54) LIQUID DROPLET JETTING APPARATUS

(71) Applicants: Toru Yamashita, Nagoya (JP); Tomoyuki Kubo, Nagoya (JP); Yasuhiro Kato, Nagoya (JP)

(72) Inventors: Toru Yamashita, Nagoya (JP); Tomoyuki Kubo, Nagoya (JP); Yasuhiro Kato, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/012,356

(22) Filed: Aug. 28, 2013

(65) Prior Publication Data

US 2014/0063126 A1 Mar. 6, 2014

(30) Foreign Application Priority Data

Sep. 4, 2012 (JP) ..... 2012-193819

(51) Int. Cl.

*B41J 2/14* (2006.01)
*B41J 2/16* (2006.01)
*B41J 2/05* (2006.01)

(52) U.S. Cl.

CPC ..... *B41J 2/14201* (2013.01); *B41J 2/14233* (2013.01); *B41J 2002/14459* (2013.01); *B41J 2002/14491* (2013.01)

(58) Field of Classification Search

CPC ..... B41J 2/25; B41J 2/255; B41J 2/26; B41J 2/265; B41J 2/27; B41J 2/16; B41J 2/1607; B41J 2/1623; B41J 2/14072; B41J 2/14129; B41J 2/14201; B41J 2002/14491

USPC ..... 347/50, 58, 59

See application file for complete search history.

(56) References Cited

U.S. PATENT DOCUMENTS

| | | | | |
|---|---|---|---|---|
| 5,956,058 | A * | 9/1999 | Momose et al. | 347/71 |
| 6,024,439 | A * | 2/2000 | Sueoka et al. | 347/50 |
| 6,119,334 | A * | 9/2000 | Watanabe et al. | 29/830 |
| 7,219,428 | B2 * | 5/2007 | Ito | 29/890.1 |
| 7,866,800 | B2 * | 1/2011 | Kubo et al. | 29/890.1 |
| 2002/0126181 | A1 * | 9/2002 | Miyamoto et al. | 347/63 |
| 2003/0145461 | A1 * | 8/2003 | Kasai et al. | 29/832 |
| 2005/0036010 | A1 * | 2/2005 | Terakura et al. | 347/71 |

(Continued)

FOREIGN PATENT DOCUMENTS

| | | | |
|---|---|---|---|
| EP | 860280 | A2 * | 8/1998 |
| JP | 200455997 | | 2/2004 |

(Continued)

*Primary Examiner* — Matthew Luu
*Assistant Examiner* — Patrick King
(74) *Attorney, Agent, or Firm* — Frommer Lawrence & Haug LLP

(57) ABSTRACT

A liquid droplet jetting apparatus configured to jet liquid droplets, includes: a channel structure; an energy applying device including a plurality of first contact points; a wiring board arranged to face the surface of the energy applying device and connected to the energy applying device. The wiring board includes second contact points electrically connected to the first contact points, respectively and signal wiring lines connected to the second contact points, respectively. Further, the liquid droplet jetting apparatus includes a sealing material arranged, between the wiring board and the energy applying device, to surround at least a part of an area in which the first and second contact points are arranged, and a recess-protrusion portion formed in an area, of the wiring board, which is positioned between the sealing material and the second contact points, and which is other than an area in which the second contact points are arranged.

17 Claims, 9 Drawing Sheets

(56) References Cited

U.S. PATENT DOCUMENTS

| | | | | |
|---|---|---|---|---|
| 2006/0131064 | A1 | 6/2006 | Hagiwara | |
| 2008/0023217 | A1 | 1/2008 | Hagiwara | |
| 2008/0316255 | A1* | 12/2008 | Kubo et al. | 347/40 |
| 2009/0096842 | A1* | 4/2009 | Kubo et al. | 347/68 |
| 2009/0244186 | A1* | 10/2009 | Ito | 347/50 |
| 2011/0134191 | A1 | 6/2011 | Kajiura | |
| 2012/0113192 | A1* | 5/2012 | Kimura et al. | 347/54 |
| 2012/0305680 | A1* | 12/2012 | Kaneko et al. | 239/589 |

FOREIGN PATENT DOCUMENTS

| | | | |
|---|---|---|---|
| JP | 2006196878 | A | 7/2006 |
| JP | 2011121186 | A | 6/2011 |

* cited by examiner

LIQUID DROPLET JETTING APPARATUS

CROSS REFERENCE TO RELATED APPLICATION

The present application claims priority from Japanese Patent Application No. 2012-193819, filed on Sep. 4, 2012, the disclosure of which is incorporated herein by reference in its entirety.

BACKGROUND OF THE INVENTION

1. Field of the Invention

The present invention relates to a liquid droplet jetting apparatus which jets liquid droplets.

2. Description of the Related Art

There has been known an ink-jet head (liquid droplet jetting apparatus) used for an ink-jet printer which records letters, an image, and the like on a recording paper sheet. The ink-jet head includes a channel unit (channel structure) in which an ink channel (liquid channel) including a plurality of nozzles is formed, a piezoelectric actuator (energy applying device) applying jetting energy for jetting liquid droplets from the nozzles to an ink (liquid) in the ink channel, and a wiring board connected to the piezoelectric actuator. The ink-jet head is assembled such that the piezoelectric actuator is joined onto the channel unit and the wiring board is joined while facing the upper surface of the piezoelectric actuator. In a so-called piezoelectric-type ink-jet head as described above, the jetting energy is applied to the ink by deforming the piezoelectric actuator.

SUMMARY OF THE INVENTION

In some cases, potting (sealing material) made of silicon and the like is desirably injected into a joining portion of the energy applying device and the wiring board in order to prevent the ink from seeping or entering into the joining portion. However, in this situation, in a case that the injected potting enters into the joining portion of the energy applying device and the wiring board, operation of the energy applying device may be adversely affected. In a case that the energy applying device is the piezoelectric actuator, there is fear that, for example, electrode displacement of a piezoelectric layer of the piezoelectric actuator is inhibited or obstructed and jetting velocity of the ink is decreased.

An object of the present teaching is to prevent a sealing material injected between an energy applying device and a wiring board from entering into a joining portion of the energy applying device and the wiring board.

According to an aspect of the present teaching, there is provided a liquid droplet jetting apparatus configured to jet liquid droplets of a liquid, including:

a channel structure in which a liquid channel including a plurality of nozzles is formed;

an energy applying device which is configured to apply jetting energy for jetting the liquid droplets from the nozzles to the liquid in the liquid channel, and includes a plurality of first contact points disposed on a surface of the energy applying device;

a wiring board arranged to face the surface of the energy applying device and connected to the energy applying device, including:

a plurality of second contact points electrically connected to the first contact points of the energy applying device, respectively; and a plurality of signal wiring lines connected to the second contact points, respectively;

a sealing material arranged, between the wiring board and the energy applying device, to surround at least a part of an area, of the wiring board, in which the first contact points and the second contact points are arranged; and a recess-protrusion portion formed in an area, of the wiring board, which is positioned between the sealing material and the second contact points and which is other than an area in which the second contact points are arranged. It is noted that the recess-protrusion portion may be a dummy wiring line which is not electrically connected to the second contact points.

According to the aspect of the present teaching, the recess-protrusion portion, such as the dummy wiring line which is not electrically connected to the second contact points, is formed in the area, of the wiring board, other than the arrangement area of the second contact points. For example, in a case that the dummy wiring line is formed in the area, of the wiring board, other than the arrangement area of the second contact points, the dummy wiring line positioned closer to the arrangement area of the second contact points than the injected sealing material makes a gap at the joining portion of the wiring board and the energy applying device smaller, and thus the sealing material injected between the wiring board and the energy applying device can be prevented from penetrating the joining portion therebetween.

DESCRIPTION OF THE PREFERRED EMBODIMENTS

Hereinbelow, an explanation will be made about an embodiment of the present teaching. The embodiment is an example in which the present teaching is applied to an ink-jet head, which jets liquid droplets of ink and is provided for an ink-jet printer performing recording of letters, an image, and the like.

Figure 1:
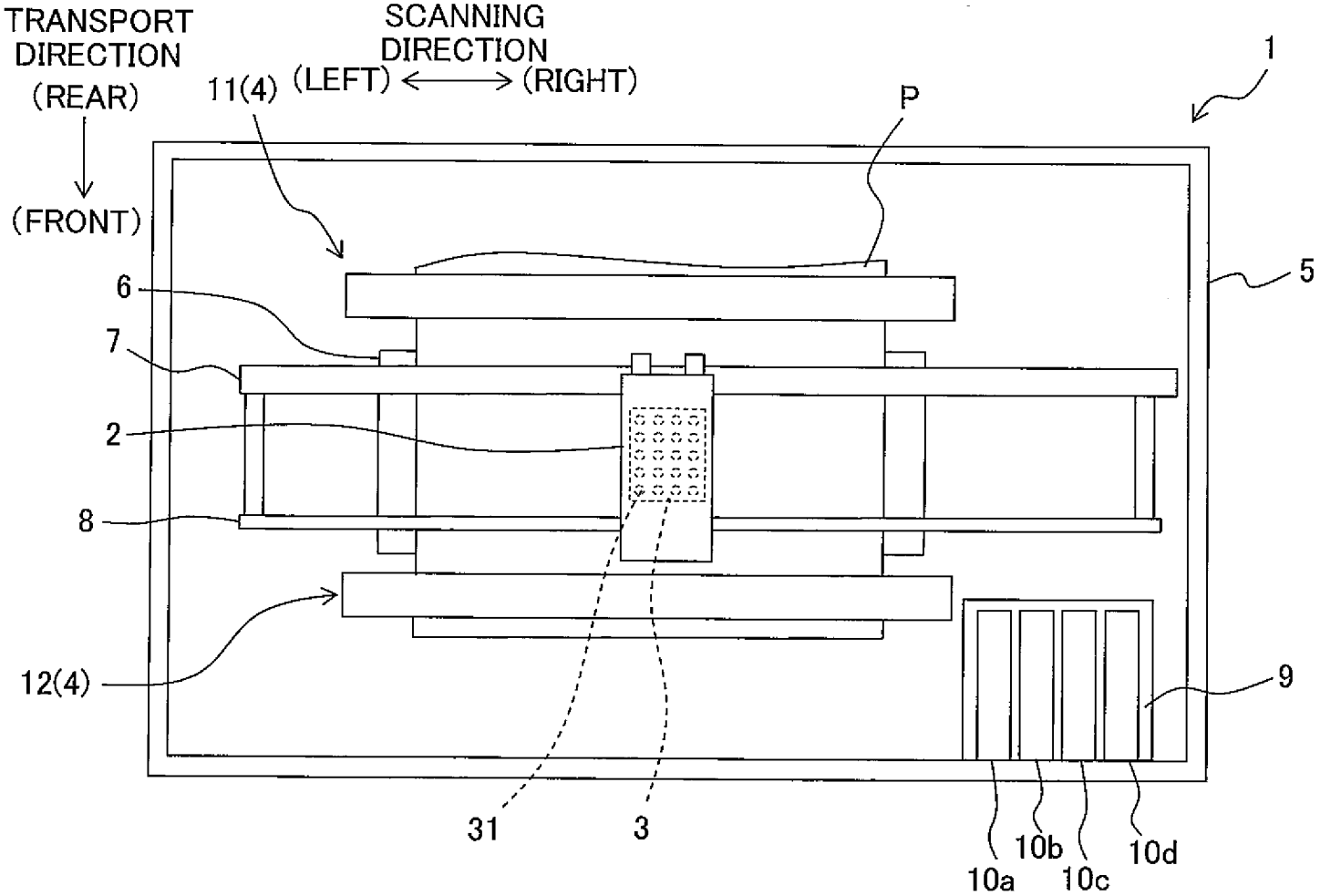
FIG. 1 is a schematic plan view of an ink-jet printer according to an embodiment of the present teaching.

In a case that an ink-jet printer 1 is placed on a horizontal surface, the front side of the page of FIG. 1 is defined to be an upper side and the back side of the page of FIG. 1 is defined to be a lower side. Hereinbelow, an explanation will be made about the ink-jet printer 1 in a state of being placed on the horizontal surface. A left-right direction and a front-rear direction are respectively defined as shown in FIG. 1. As shown in FIG. 1, the ink-jet printer 1 includes, for example, a carriage 2 configured to be movable reciprocatingly in the left-right direction as a predetermined scanning direction, an ink-jet head 3 (liquid droplet jetting apparatus) mounted on the carriage 2, and a transport mechanism 4 configured to transport a recording paper sheet P, along the horizontal surface, in a transport direction perpendicular to the predetermined scanning direction, that is in a frontward direction. In the following description, a direction parallel to the horizontal surface is defined as a horizontal direction. The left-right direction and the front-rear direction are included in the horizontal direction.

In a printer casing 5, a platen 6 supporting the recording paper sheet P is provided along the horizontal surface. Two guide rails 7 and 8 extending in the scanning direction are provided above the platen 6. The carriage 2 is driven by a carriage drive motor (not shown) to move in the scanning direction along the two guide rails 7 and 8 in an area, on the platen 6, facing the recording paper sheet P.

Figure 2:
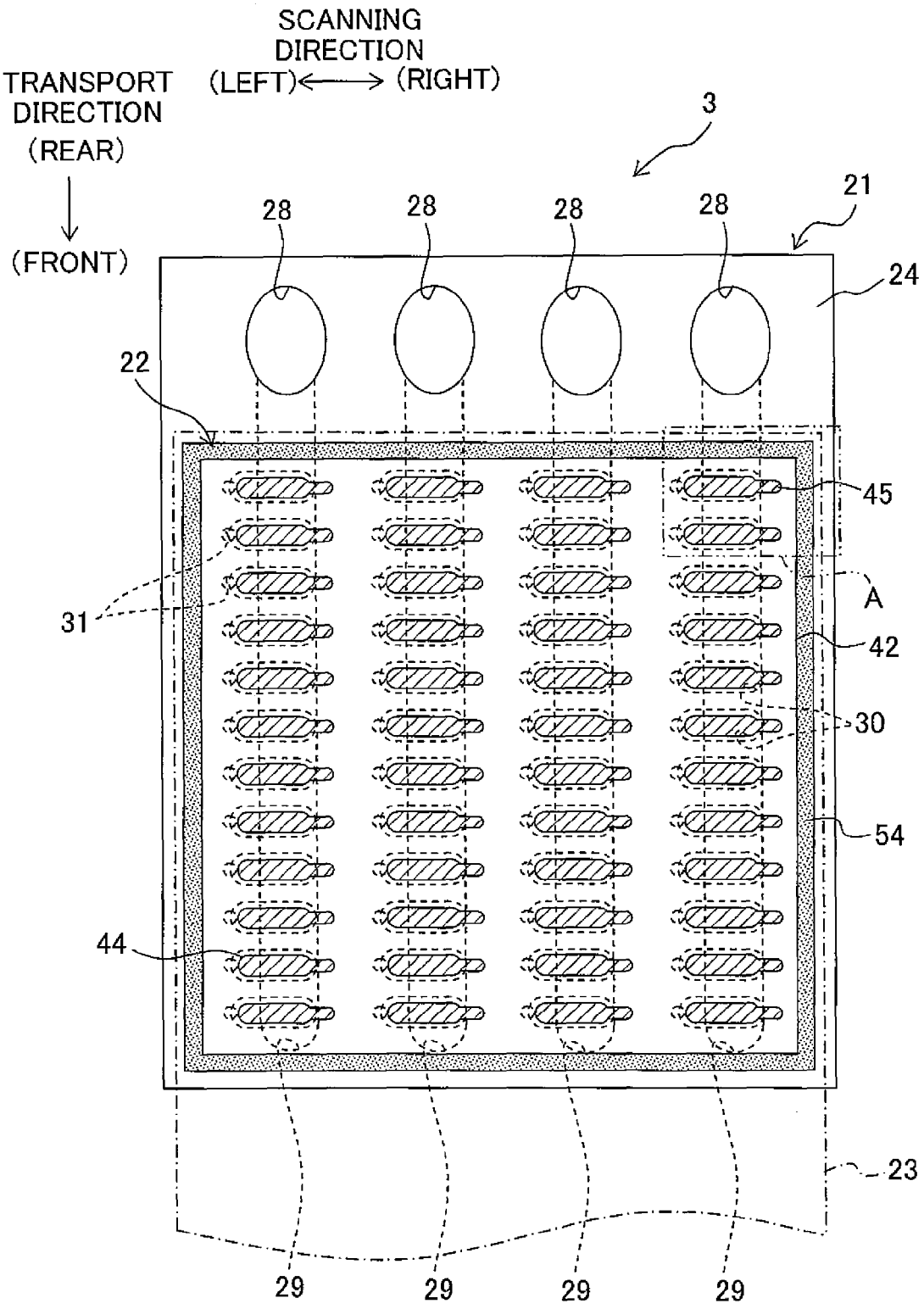
FIG. 2 is a plan view of an ink-jet head.

The ink-jet head 3 is attached to the lower portion of the carriage 2 along the horizontal direction while having a space between the platen 6 and the ink-jet head 3. As shown in FIG. 2, the lower surface of the ink-jet head 3 is a liquid droplet jetting surface having a plurality of nozzles 31 formed thereon. The ink-jet head 3 mounted in the carriage 2 is connected to an ink cartridge holder 9 via tubes (not shown). Four colors of inks including magenta, cyan, yellow, and black contained in four respective ink cartridges 10*a*, 10*b*, 10*c*, and 10*d* installed to the ink cartridge holder 9 are supplied to the ink-jet head 3 via respective tubes.

The ink-jet head 3 is movable, together with the carriage 2, not only within a range in which the ink-jet head 3 faces the recording paper sheet P transported on the platen 6 but also to a position shifted outsides of said range in the left-right direction. A waiting position at which the carriage 2 is positioned in a case that the ink-jet head 3 is not used is provided on the right side of the range in which the ink-jet head 3 faces the recording paper sheet P. When the ink-jet head 3 arrives at the waiting position, the ink-jet head 3 is opposed to a maintenance unit (not shown) disposed on the lower side of the waiting position, and maintenance of the ink-jet head 3 is performed by the maintenance unit. Details of the ink-jet head 3 will be described later.

The transport mechanism 4 includes two transport rollers 11, 12 disposed to be apart from each other in the front-rear direction to interpose the platen 6 and the carriage 2. The transport rollers 11, 12 are driven by a transport motor (not shown) to transport the recording paper sheet P between the ink-jet head 3 and the platen 6 in the transport direction.

The ink-jet printer 1 as described above is configured so that the ink is jetted to the recording paper sheet P on the platen 6 from the ink-jet head 3 while moving the carriage 2 in the scanning direction. Further, the ink-jet printer 1 is configured so that a desired image, letters, and the like, are recorded on the recording paper sheet P by transporting the recording paper sheet P in the transport direction by the two transport rollers 11, 12.

Figure 3:
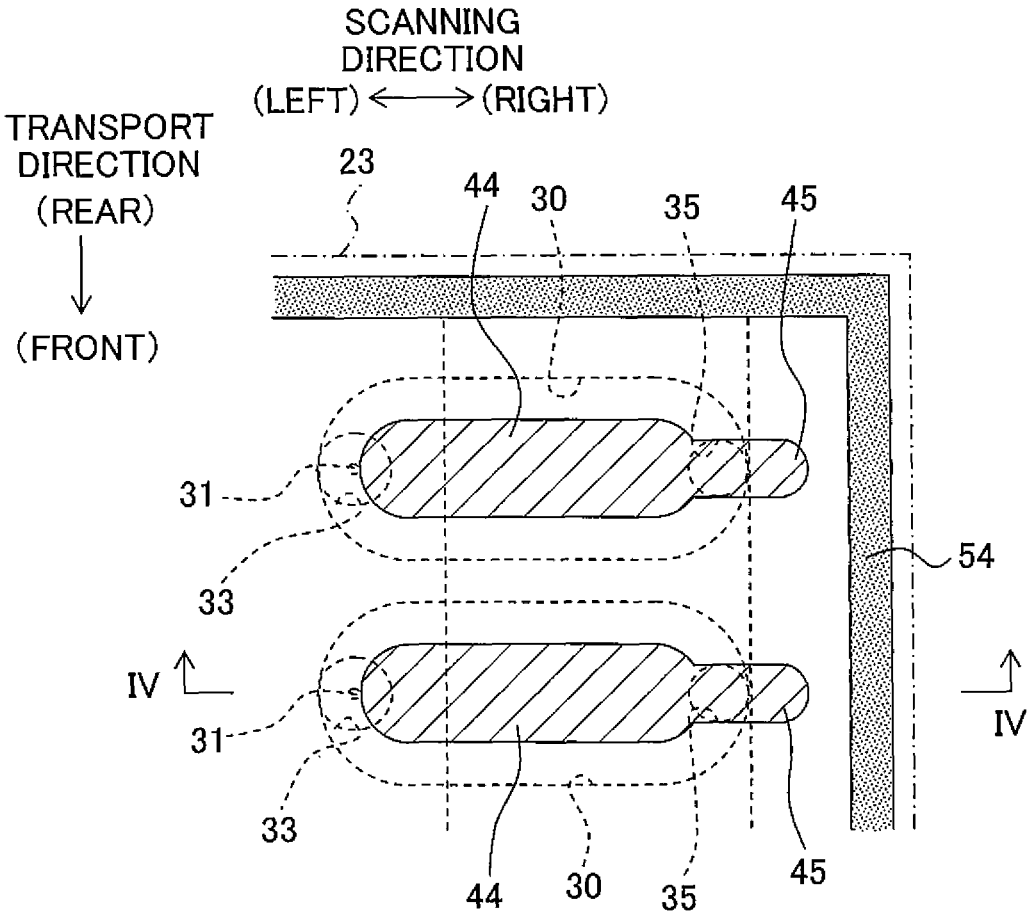
FIG. 3 is an enlarged view of a section A of FIG. 2.
Figure 4:
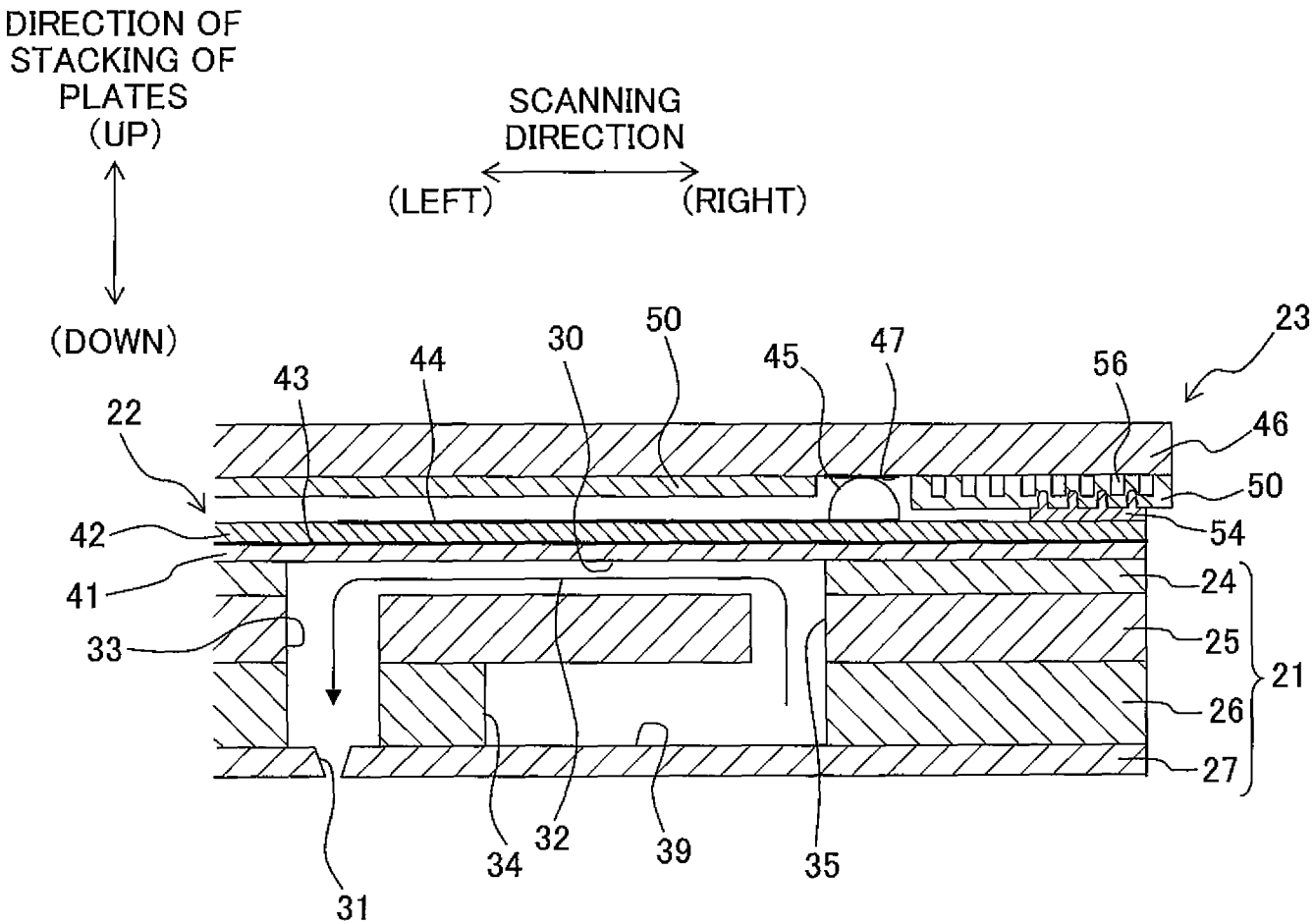
FIG. 4 is a cross-sectional view taken along a line IV-IV of FIG. 3.

Hereinbelow, the ink-jet head 3 will be explained. As shown in FIGS. 2 to 4, the ink-jet head 3 includes a channel unit 21 (channel structure) in which an ink channel (liquid channel) including the plurality of nozzles 31 is formed, a piezoelectric actuator 22 (energy applying device) applying jetting energy for jetting the liquid droplets from the nozzles 31 to the ink (liquid) in the channel unit 21, and a flexible printed circuit board (wiring board) 23 connected to the piezoelectric actuator 22. Hereinbelow, the flexible printed circuit board is referred to as FPC. In FIGS. 2 and 3, the FPC 23 is depicted by alternate long and short dash lines.

As shown in FIG. 4, the channel unit 21 has a structure in which four plates each having a hole forming a part of the ink channel are stacked in an up-down direction. Here, the four plates are a cavity plate 24, a base plate 25, a manifold plate 26, and a nozzle plate 27. The four plates 24 to 27 are joined to one another by an adhesive. Further, each of the three plates 24 to 26, except for the nozzle plate 27 as the lowermost layer, is formed of a metallic material such as a stainless steel plate and a nickel alloy steel plate. The nozzle plate 27 as the lowermost layer is formed of a synthetic resin material such as polyimide.

As shown in FIGS. 2 to 4, the channel unit 21 which is a stacked body of the four plates 24 to 27 includes ink supply ports 28 connected to the ink cartridges 10*a* to 10*d* via the tubes, manifolds 29 communicating with the respective ink supply ports 28 and extending in the front-rear direction as a predetermined transport direction, and a plurality of individual ink channels 32 extending from the respective manifolds 29 via a plurality of pressure chambers 30 to arrive at the plurality of nozzles 31. The inks of magenta, cyan, yellow, and black are supplied to the respective manifolds 29 via the respective supply ports 28 in the order of nozzle rows from the left side of FIG. 2.

In the nozzle plate 27 as the lowermost layer of the channel unit 21, the plurality of nozzles 31 are arranged in the transport direction at a predetermined pitch to form four nozzle arrays aligned in the scanning direction perpendicular to the transport direction. In the cavity plate 24 arranged as the uppermost layer, the pressure chambers 30 arranged at the predetermined pitch in a similar manner as the nozzles 31 are disposed to form four arrays of pressure chamber arrays. As shown in FIG. 4, communication channels 33, each of which communicates the pressure chamber 30 with the nozzle 31, are formed in two plates 25, 26 provided between the cavity plate 24 and the nozzle plate 27. As shown in FIG. 2, ink supply ports 28 connected to the respective ink cartridges 10*a* to 10*d* via the tubes, are formed in the cavity plate 24 at a rear end portion which is one end portion of the cavity plate 24 in the transport direction.

As shown in FIG. 4, elongated holes 34, each of which penetrates through the manifold plate 26 in a thickness direction and extends in the transport direction, are formed in the manifold plate 26. Each of the elongated holes 34 is blocked from the up-down direction, which is a direction of stacking of the plates 24 to 27, with the base plate 25 disposed on the upper side and the nozzle plate 27 disposed on the lower side. Accordingly, each of the manifolds 29 is formed.

As shown in FIG. 2, each of the manifolds 29 extends in the transport direction along one of the nozzle arrays and is communicated with the pressure chambers 30 belonging to one of the pressure chamber arrays. That is, each of the manifolds 29 supplies the ink to one of the pressure chamber arrays. In other words, each of the manifolds 29 supplies the ink to one of the nozzle arrays.

As shown in FIG. 4, a plurality of communication channels 35 are formed in the base plate 25 positioned between the cavity plate 24 and the manifold plate 26. Each of the communication channels 35 communicates the manifold 29 with the pressure chamber 30 belonging to the pressure chamber array corresponding to the manifold 29.

By joining the four plates 24 to 27 in a stacked state, there are formed, in the channel unit 21, the plurality of individual ink channels 32, each of which extends from the manifold 29 via the communication channel 35, the pressure chamber 30, and the communication channel 33 to arrive at the nozzle 31, as shown in FIG. 4.

Next, an explanation will be made about the piezoelectric actuator 22. As shown in FIGS. 2 to 4, the piezoelectric actuator 22 includes a vibration plate 41 which is joined onto the upper surface of the cavity plate 24 forming the channel unit 21, a piezoelectric layer 42 which is joined onto the upper surface of the vibration plate 41, a common electrode 43 disposed between the vibration plate 41 and the piezoelectric layer 42, a plurality of individual electrodes 44 which are arranged on the upper surface of the piezoelectric layer 42 to face the pressure chambers 30, and a plurality of bumps 45 (first contact points), each of which is provided one end portion of one of the individual electrodes 44.

The vibration plate 41 is, in a plane view, an approximately rectangular metallic plate which is, for example, formed of an iron-based alloy such as stainless steel, a copper-based alloy, a nickel-based alloy, a titanium-based alloy, or the like. The vibration plate 41 is adhered to the upper surface of the channel unit 21 to cover the plurality of pressure chambers 30.

The piezoelectric layer 42, which is made of a piezoelectric material of which major component is lead zirconate titanate (PZT) that is a solid solution of lead titanate and lead zirconate and is a ferroelectric, is adhered, by the adhesive, on the surface on the side opposite to the pressure chambers 30 which is the upper surface of the vibration plate 41. The piezoelectric layer 42 is formed in a flat or planar form while extending over the pressure chambers 30. The common electrode 43 is disposed between the vibration plate 41 and the piezoelectric layer 42 and is constantly kept at ground potential.

The plurality of individual electrodes 44, each of which has a substantially elliptical shape slightly smaller than the pressure chamber 30 as viewed in a plan view, are formed on the upper surface of the piezoelectric layer 42. Each of the individual electrodes 44 is arranged at the position facing the center portion of one of pressure chambers 30. Each of the individual electrodes 44 is formed of a conductive material including, for example, gold, copper, silver, palladium, platinum, and titanium.

The one end portion of each of the individual electrodes 44 positioned on the upper surface of the piezoelectric layer 42, that is, the end portion on the side opposite to the corresponding nozzle 31 as viewed in a plan view is led to an area which is not opposed to the corresponding pressure chamber 30. The plurality of bumps 45 are provided at the one end portions of the individual electrodes 44, respectively. Accordingly, the bumps 45 are formed on the upper surface of the piezoelectric actuator 22. Each of the bumps 45 is formed to project upward by an electrically conductive adhesive. The FPC 23 is connected to the bumps 45. Driving voltage is applied to the individual electrodes 44 from a driver IC 49 mounted on the FPC 23 via the bumps 45.

An explanation will be made about operation of the piezoelectric actuator 22 at the time of jetting the ink from each of the nozzles 31. The driving voltage is applied to one individual electrode 44 from the driver IC 49. In this situation, a potential difference occurs between the individual electrode 44 disposed on the upper side of the piezoelectric layer 42 and the common electrode 43 disposed on the lower side of piezoelectric layer 42 and kept at the ground potential, and thereby the electric field in the thickness direction acts in a portion, of the piezoelectric layer 42, sandwiched between the individual electrode 44 and the common electrode 43. When the direction of the electric field is same as a polarization direction of the piezoelectric layer 42, the piezoelectric layer 42 is deformed so that the piezoelectric layer 42 extends or elongates in the thickness direction thereof which is the polarization direction thereof and that the piezoelectric layer 42 contracts in a planar direction. In this situation, with the contraction deformation (deformation due to contraction) of the piezoelectric layer 42, the portion of the vibration plate 41 facing the pressure chamber 30 is bent or deformed to form a projection toward the pressure chamber 30. The deformation is a so-called unimorph deformation. At this time, since the volume of the pressure chamber 30 reduces, the pressure, that is, jetting energy is applied to the ink in the pressure chamber 30, and thereby liquid droplets of the ink are jetted from the nozzle 31 communicating with the pressure chamber 30.

Next, an explanation will be made about the FPC 23. As shown in FIGS. 2 to 5, the FPC 23 includes a substrate 46, a plurality of lands 47 (second contact points), a plurality of signal wiring lines 48, the driver IC 49, and the like.

Figure 5:
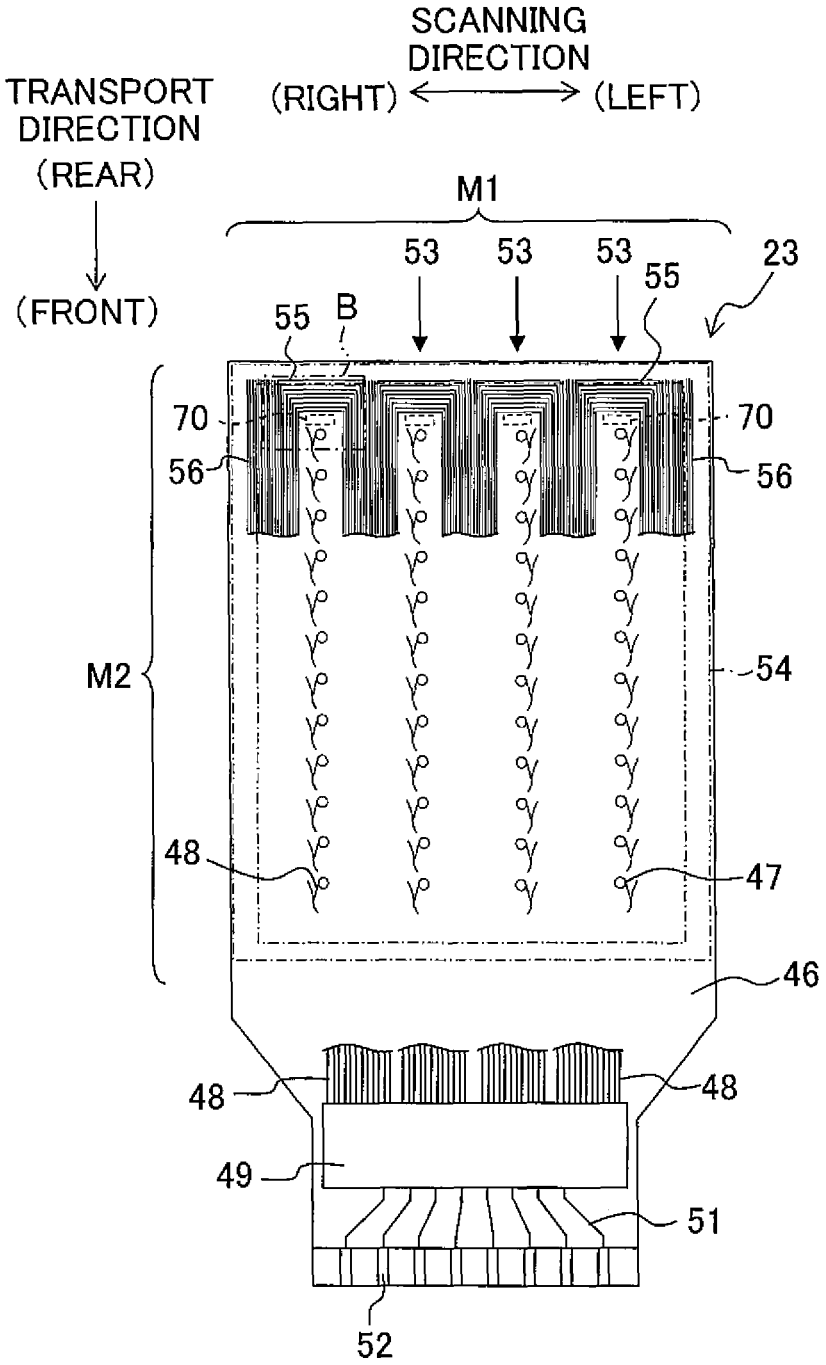
FIG. 5 is a schematic bottom view of a FPC as viewed from a side of a connecting surface for connecting with a piezoelectric actuator 22.

The substrate 46 is formed of a flexible material such as polyimide. The lands 47 are provided on the lower surface of the substrate 46 which is the connecting surface, of the substrate 46, for connecting with the piezoelectric actuator 22. The lands 47 correspond to the bumps 45 of the piezoelectric actuator 22. The lands 47 form four land arrays (contact point arrays) 53 extending in the transport direction. In a case that the FPC 23 is arranged to face the upper surface which is one of the surfaces of the piezoelectric actuator 22, the bumps 45 and the lands 47 are electrically connected to each other. The plurality of signal wiring lines 48 are provided on the lower surface which is the connecting surface, of the substrate 46, for connecting with the piezoelectric actuator 22. The signal wiring lines 48 extend in the transport direction (front-rear direction), and one end portions of the signal wiring lines 48 are connected to the lands 47, respectively. The other end portions of the signal wiring lines 48 are connected to the driver IC 49. In FIG. 5, portions, of the signal wiring lines 48, between the lands 47 and the driver IC 49 are omitted.

The driver IC 49 is connected to the signal wiring lines 48. Further, the driver IC 49 is connected to connecting terminals 52 via a plurality of signal wiring lines 51. The connecting terminals 52 are connected to a control board (not shown) for controlling the driver IC 49. The driver IC 49 applies the driving voltage to the individual electrodes 44 via the signal wiring lines 48, the lands 47, and the bumps 45.

In the FPC 23, an insulating layer 50 (for example, solder resist) covering, other than the lands 47, the signal wiring lines 48 and the like, is provided on the lower surface which is the connecting surface of the substrate 46. In the FPC 23, the bumps 45 and the lands 47 are electrically connected to each other in a state that the FPC 23 is disposed to face the upper surface of the piezoelectric actuator 22. Accordingly, the driver IC 49 and the individual electrodes 44 are connected to each other via the signal wiring lines 48, the lands 47, and the bumps 45. Further, reinforcing bumps 70 depicted by broken lines in FIG. 5 are provided, on the piezoelectric actuator 22, in the vicinity of rear end portions, which are one end portions of the respective land arrays 53 in the transport direction (front-rear direction). The reinforcing bumps 70 are provided to prevent the FPC 23 from being peeled off from the piezoelectric actuator 22, and the reinforcing bumps 70 are not electrically connected to the lands 47. For the FPC 23, the one end side (front side) at which the driver IC 49 is arranged is bent and folded upward toward the other end side (rear side) in a state that the ink-jet head 3 is attached to the carriage 2.

As described above, the piezoelectric actuator 22 is joined to the upper surface of the channel unit 21. Further, the FPC 23 is joined to the upper surface of the piezoelectric actuator 22. The ink is jetted from the nozzles 31 of the channel unit 21. A potting 54 is injected into a joining portion of the piezoelectric actuator 22 and the FPC 23 in order to prevent the ink jetted from the nozzles 31 from seeping or entering into the joining portion of the piezoelectric actuator 22 and the FPC 23. In particular, the potting 54 is injected between the connecting surfaces of the FPC 23 and the piezoelectric actuator 22 along the entire circumference of the edge of the piezoelectric actuator 22. In a case that the potting 54 is injected along the entire circumference of the edge of the piezoelectric actuator 22, the potting 54 flows toward the inside and is positioned to surround the arrangement area of the bumps 45 and the lands 47 corresponding to the bumps 45. In FIG. 5, the position of the potting 54 is depicted by alternate long and short dash lines.

Figure 6:
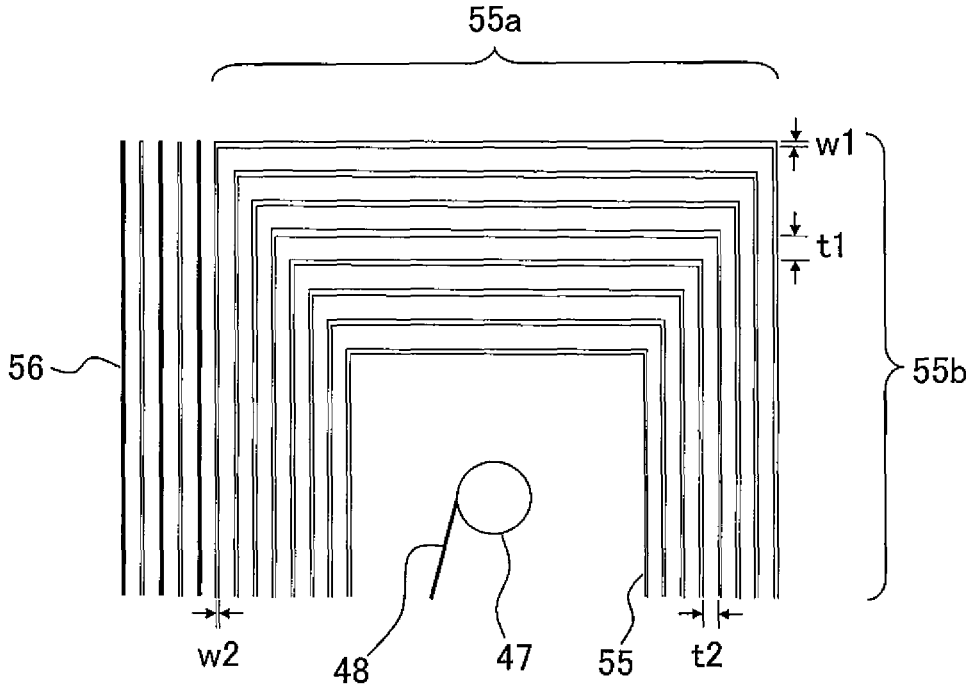
FIG. 6 is an enlarged view of a section B of FIG. 5.

The piezoelectric layer 42 and the individual electrodes 44 forming the piezoelectric actuator 22 are positioned at the inside of the potting 54 which is the joining portion of the piezoelectric actuator 22 and the FPC 23. Thus, in a case that the potting 54 injected between the piezoelectric actuator 22 and the FPC 23 penetrates or enters the joining portion of the piezoelectric actuator 22 and the FPC 23, there is fear that, for example, electrode displacement of the piezoelectric layer 42 of the piezoelectric actuator 22 is inhibited or obstructed and jetting velocity of the ink is decreased. As described above, in the case that the potting 54 injected between the piezoelectric actuator 22 and the FPC 23 penetrates or enters the joining portion of the piezoelectric actuator 22 and the FPC 23, there is the possibility that operation of the piezoelectric actuator 22 is adversely affected. Therefore, as shown in FIGS. 5 and 6, dummy wiring lines 55, 56 which are not electrically connected to the lands 47 are formed in an area, of the FPC 23, other than the arrangement area of the lands 47. As shown in FIG. 4, the dummy wiring lines 55, 56 positioned at the inside of the injected potting 54, in other words, the dummy wiring lines 55, 56 positioned on the side closer to the bumps 45 and the lands 47 than the injected potting 54 make a gap at the joining portion of the FPC 23 and the piezoelectric actuator 22 smaller. Accordingly, it is possible to prevent the injected potting 54 from penetrating the joining portion of the FPC 23 and the piezoelectric actuator 22. As described above, although the signal wiring lines 48 are connected to the lands 47, respectively, the dummy wiring lines 55, 56 are dummy wiring lines which are not electrically connected to the lands 47. Further, the arrangement area of the lands 47 indicates an area in which the lands 47 are disposed. The dummy wiring lines 55, 56 are formed in the area in which no land 47 is formed. The area in which the potting 54 is positioned includes a first area M1 along the scanning direction (left-right direction) perpendicular to the transport direction (front-rear direction) and a second area M2 along the transport direction (front-rear direction). The potting 54 in the first area M1 flows in the transport direction (front-rear direction) perpendicular to the scanning direction to be positioned in the area shown in FIG. 5. The potting 54 in the second area M2 flows in the scanning direction (left-right direction) perpendicular to the transport direction to be positioned in the area shown in FIG. 5.

The dummy wiring lines 55 (eight dummy wiring lines 55 in this embodiment) positioned around each of the land arrays 53 each include a first portion 55*a* extending in the scanning direction (left-right direction) perpendicular to the transport direction, on any one of the sides (rear side in this embodiment), of the lands 47 arranged in the transport direction, in the transport direction (front-rear direction). Further, the dummy wiring lines 55 each include a pair of second portions 55*b* extending in the transport direction while sandwiching each of the land arrays 53 from the both end portions of the first portion 55*a*. That is, each of the dummy wiring lines 55 includes a portion having a substantially U-shape. Accordingly, by providing the first portions 55*a* to extend in a direction perpendicular to the transport direction in which the lands 47 are aligned, it is possible to prevent the injected potting 54 from penetrating or entering to the bumps 45 and the lands 47. Further, by providing the second portions 55*b* to extend in the transport direction (front-rear direction) while sandwiching each of the land arrays 53, it is possible to prevent the injected potting 54 from penetrating or entering to the bumps 45 and the lands 47. In a case that the dummy wiring lines are divided, there is the possibility that the potting 54 enters from the divided portion. However, since the first portion 55*a* and the second portions 55*b* are continuously formed in each of the dummy wiring lines 55, the entering of the potting 54 can be prevent reliably. Noted that, the dummy wiring lines 56, other than the eight dummy wiring lines 55 positioned around each of the land arrays 53, do not have the substantially U-shaped portion and extend in the transport direction. In FIG. 5, although the second portions 55*b* of the dummy wiring lines 55 and the dummy wiring lines 56 extend toward the driver IC 49 (frontward direction) along the front-rear direction which is the transport direction, the illustration thereof is omitted from the intermediate portions of the second portions 55*b* of the dummy wiring lines 55 and the dummy wiring lines 56. In FIG. 5, the ground wiring lines (not shown) are drawn from the left and right portions of the connecting terminals 52 so that the ground wiring lines are not connected to the driver IC 49. The ground wiring lines are arranged at outer sides of the dummy wiring lines 56 in the scanning direction, and the potting 54 is injected at an outer portion of the ground wiring lines in the scanning direction. Since the ground wiring lines do not have any protruded portions or recessed portions, the ground wiring lines can not prevent the injected potting 54 from going over the ground wiring lines. However, since the dummy wiring lines are arranged at an inner area of the ground wiring lines in the scanning direction, it is possible to prevent the injected potting 54 from entering the joining portion of the FPC 23 and the piezoelectric actuator 22.

For each of the dummy wiring lines 55, a spacing distance t1, between adjacent first portions 55*a*, in which no dummy wiring line 55 is formed is larger than a spacing distance t2, between adjacent second portions 55*b*, in which no dummy wiring line 55 is formed. Therefore, a large recess portion by the dummy wiling lines 55 is formed between adjacent first portions 55*a*. Thus, even when the potting 54 goes over a part of the dummy wiring lines 55, the potting 54 is accommodated in the recess portion positioned between adjacent first portions 55*a*. Accordingly, the potting 54 is reliably prevented from penetrating the joining portion of the FPC 23 and the piezoelectric actuator 22. Further, the second portions 55*b* each disposed to have the narrow spacing distance t2 in which no dummy wiring line 55 is formed function as resistance, and prevent the injected potting 54 from entering the joining portion of the FPC 23 and the piezoelectric actuator 22.

For the dummy wiring lines 55, the spacing distance t2, between adjacent second portions 55*b*, in which no dummy wiring line 55 is formed, is equal to a spacing distance, between adjacent signal wiring lines 48, in which no signal wiring line 48 is formed. Here, an explanation will be simply made about formation of the signal wiring lines 48 and the dummy wiring lines 55, 56. A metallic layer to be the signal wiring lines 48 and the dummy wiring lines 55, 56 is formed on the surface (lower surface) of the substrate 46. A cured resist film subjected to patterning is formed on the metallic layer. A portion, of the metallic layer, on which no cured resist film is formed is removed by immersing the substrate 46 formed with the metallic layer and the cured resist film in an etching liquid, and thereby forming the signal wiring lines 48 and the dummy wiring lines 55, 56. For space conservation, the signal wiring lines 48 are formed, along the transport direction, between the land arrays 53 aligned in the scanning direction. Therefore, since the wiring lines 48 and the second portions 55*b* extending in the transport direction have the same construction as described above, patterning of the resist film, control of the etching liquid, and the like are performed easily at the time of forming the wiring lines. Thus, the signal wiring lines 48 and the second portions 55*b* of the dummy wiling lines 55 are formed easily at the time of forming the wiring lines.

Further, for the dummy wiring lines 55, a width w1 of each of the first portions 55*a* is larger than a width w2 of each of the second portions 55*b*. Therefore, the first portions 55*a* each having the large width w1 reliably prevent the potting 54 from penetrating the joining portion of the FPC 23 and the piezoelectric actuator 22. Further, since the recess portion by the dummy wiling lines 55 is formed between adjacent first portions 55*a*, even when the potting 54 goes over a part of the dummy wiring lines 55, the potting 54 is accommodated in the recess portion positioned between adjacent first portions 55*a*. Accordingly, the potting 54 is reliably prevented from penetrating the joining portion of the FPC 23 and the piezoelectric actuator 22.

As shown in FIG. 4, an area of the insulating layer 50 in which the dummy wiring lines 56 are provided has a greater thickness than an area of the insulating layer 50 in which no dummy wiring line 56 is provided. Accordingly, a gap between the area of the insulating layer 50 in which the dummy wiring lines 56 are provided and the upper surface of the piezoelectric layer 42 is decreased, and thereby the potting 54 is reliably prevented from penetrating the joining portion of the FPC 23 and the piezoelectric actuator 22.

Here, an explanation will be made about an order in which the potting 54 is injected. At first, the potting 54 is injected, on the rear side (side away from the driver IC 49), in an area facing the dummy wiring lines 55 along the scanning direction. Next, the potting 54 is injected, on the left side, along the transport direction. Next, the potting 54 is injected, on the right side, along the transport direction. Finally, the potting 54 is injected, on the front side (side close to the driver IC 49), along the scanning direction. Depending on the spacing distance t1 between adjacent dummy wiring lines 55 in which no dummy wiring line 55 is formed, the potting 54 injected into the area facing the dummy wiling lines 55 flows, in some cases, due to capillary force, in the scanning direction which is a direction in which the dummy wiring lines 55 extend. Since the dummy wiring lines 55 and 56 are continuously formed, when the potting 54 injected in the area facing the dummy wiring lines 55 flows to arrive at the dummy wiring lines 56, the potting 54 further flows, in some cases, in the transport direction along the dummy wiring lines 56 due to the capillary force of the dummy wiring lines 56. The potting 54 entering the dummy wiring lines 56 fills a gap between the insulating layer 50 and the piezoelectric layer 42, and thereby the potting 54 injected subsequently can be prevented from penetrating the joining portion of the FPC 23 and the piezoelectric actuator 22. Noted that, in a case that the potting 54 is first injected on the left side or right side, the potting 54 injected in the area facing the dummy wiring lines 55 prevents the potting 54 injected subsequently from penetrating the joining portion of the FPC 23 and the piezoelectric actuator 22. The potting 54 is injected by discharging the potting 54 while moving a dispenser along the edge of the piezoelectric actuator 22.

As described above, since the signal wiring lines 48 are formed along the transport direction (front-rear direction), the dummy wiring lines are easily formed in a direction along the transport direction similar to the signal wiring lines 48. This is because, for example, formation of the signal wiring lines 48 in the transport direction allows the etching liquid to be more likely to flow in the transport direction. Therefore, in this embodiment, the dummy wiring lines 56 other than the dummy wiring lines 55 are formed to extend in the transport direction, which is a direction in which the dummy wiring lines 56 are easily formed.

In the above description, the embodiment of the present teaching has been described. However, an embodiment to which the present teaching is applicable is not limited thereto. Various changes can be added without departing from the scope of the present teaching as exemplified below.

Figure 7:
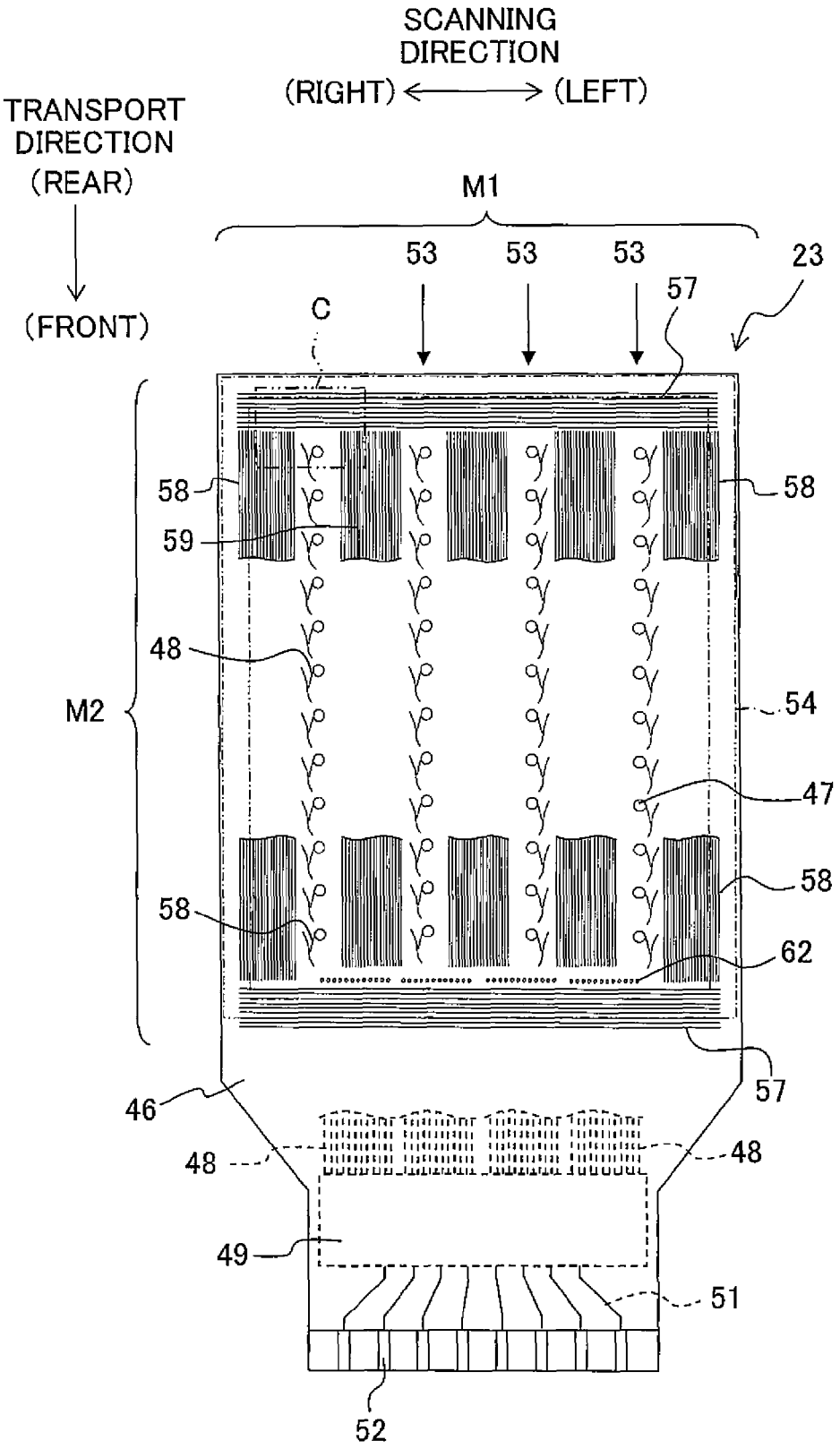
FIG. 7 is a schematic bottom view of a FPC according to a modified embodiment.
Figure 8:
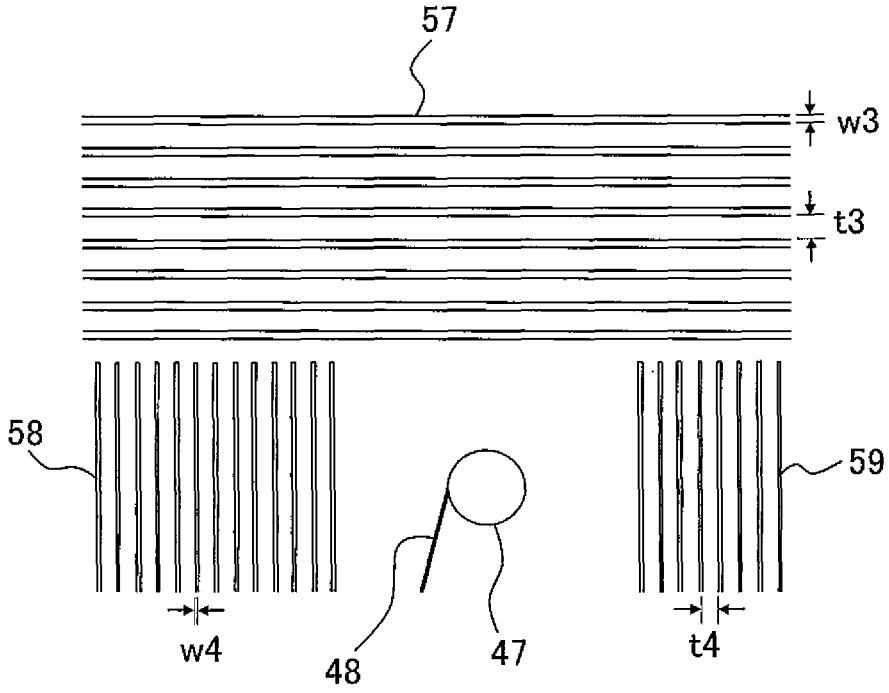
FIG. 8 is an enlarged view of a section C of FIG. 7.

In a modified embodiment shown in FIGS. 7 and 8, the driver IC 49 is arranged on the upper surface of the substrate 46 which is a surface opposite to the connecting surface for connecting with the piezoelectric actuator 22. Therefore, the signal wiring lines 48 on the lower surface of the substrate 46 are led to the upper surface of the substrate 46 at the intermediate portions thereof, via through holes 62 passing through the substrate 46, and are connected to the driver IC 49 on the upper surface of the substrate 46.

As shown in FIGS. 7 and 8, first dummy wiring lines 57 and second dummy wiring lines 58 extend along an area in which the potting 54 is injected. That is, the first dummy wiring lines 57 and the second dummy wiring lines 58 extend along the lands 47 to surround the lands 47. In particular, the dummy wiring lines 57 extend, on the front and rear sides of the substrate 46, along the left-right direction which is the scanning direction perpendicular to the transport direction. Further, the second dummy wiring lines 58 extend, on the left and right sides of the substrate 46, along the front-rear direction which is the transport direction. Accordingly, the first dummy wiring lines 57 extending in the scanning direction, which is perpendicular to the transport direction in which the lands 47 are aligned, can prevent the injected potting 54 from penetrating to the bumps 45 and the lands 47. Further, the second dummy wiring lines 58 extending in the transport direction in which the lands 47 are aligned can prevent the injected potting 54 from penetrating to the bumps 45 and the lands 47. A plurality of third dummy wiring lines 59 extending in the transport direction are provided between adjacent land arrays 53.

A spacing distance t3, between adjacent first dummy wiring lines 57, in which no first dummy wiring line 57 is formed is larger than a spacing distance t4, between adjacent second dummy wiring lines 58, in which no second dummy wiring line 58 is formed. Therefore, since a large recess portion by the first dummy wiring lines 57 is formed between adjacent first dummy wiring lines 57, even when the potting 54 goes over a part of the first dummy wiring lines 57, the potting 54 is accommodated in the recess portion positioned between adjacent first dummy wiring lines 57. Accordingly, the potting 54 is reliably prevented from penetrating the joining portion of the FPC 23 and the piezoelectric actuator 22.

The spacing distance t4, between adjacent second dummy wiring lines 58, in which no second dummy wiring line 58 is formed is equal to the spacing distance, between adjacent signal wiring lines 48, in which no signal wiring line 48 is formed. Therefore, since the wiring lines 48 and the second dummy wiring lines 58 extending in the transport direction have the same construction as described above, patterning of the resist film, control of the etching liquid, and the like are performed easily. Thus, the signal wiring lines 48 and the second dummy wiring lines 58 are formed easily at the time of forming the wiring lines.

Further, the width w3 of each of the first dummy wiring lines 57 is greater than the width w4 of each of the second dummy wiring lines 58. Therefore, the first dummy wiring lines 57 each having the large width w3 reliably prevent the potting 54 from penetrating the joining portion of the FPC 23 and the piezoelectric actuator 22. Further, since the recess portion by the first dummy wiring lines 57 is formed between adjacent first dummy wiring lines 57, even when the potting 54 goes over a part of the first dummy wiring lines 57, the potting 54 is accommodated in the recess portion. Accordingly, the potting 54 is reliably prevented from penetrating the joining portion of the FPC 23 and the piezoelectric actuator 22.

Figure 9:
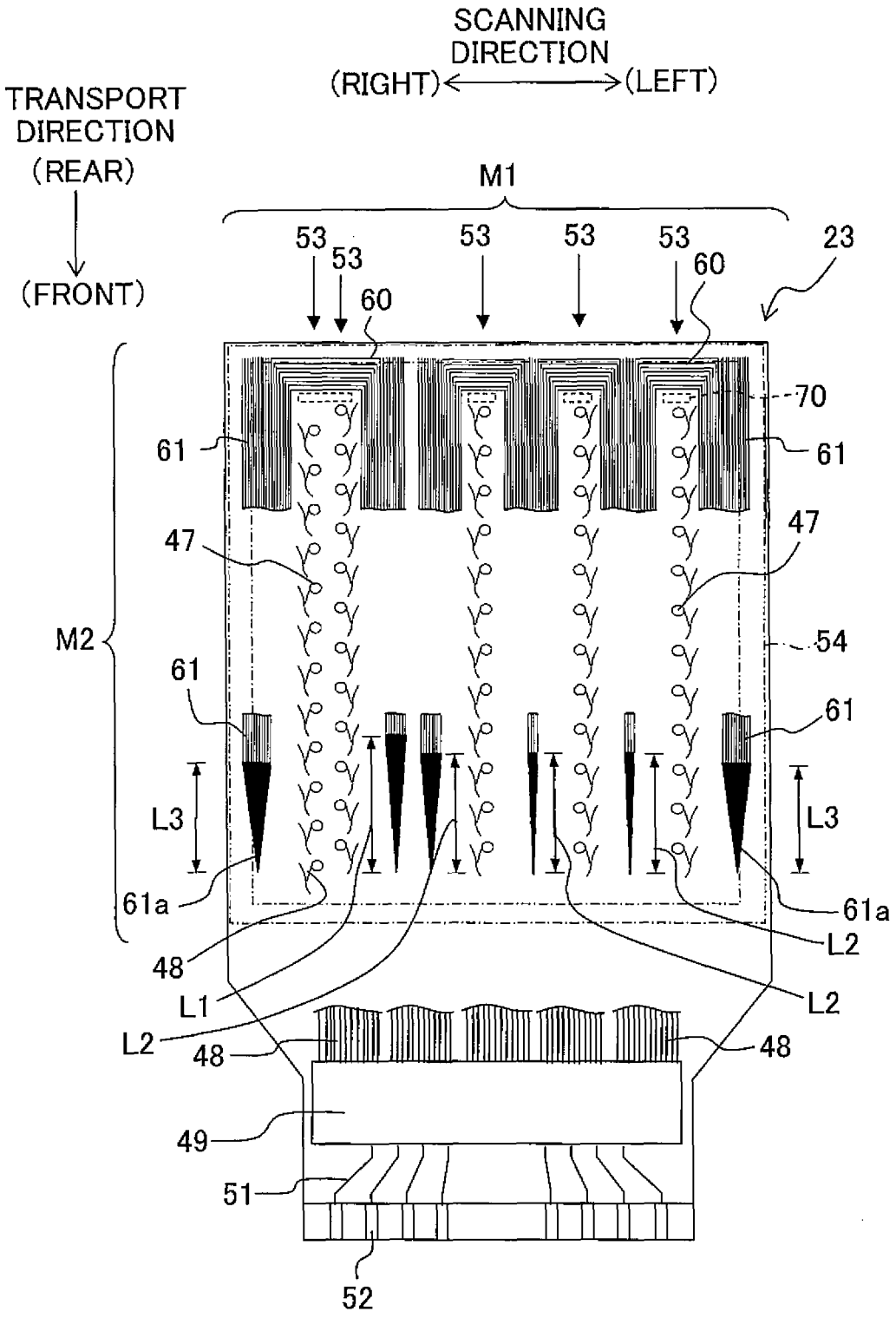
FIG. 9 is a schematic bottom view of a FPC according to another modified embodiment.

In the ink-jet head, frequencies of usage of the nozzle arrays are different from one another in some cases. For example, the ink-jet head includes, in some cases, two nozzle arrays for black ink, one nozzle array for magenta ink, one nozzle array for cyan ink, and one nozzle array for yellow ink. In this case, all of the two nozzle arrays for the black ink are used for high-resolution text printing in black and white. On the other hand, for color printing, only one nozzle array, of the two nozzle arrays for the black ink, is used in order to adjust color resolution. As described above, the frequencies of the usage of the two nozzle arrays for the black ink are different from each other in some cases. Since there are provided the two nozzle arrays for the black ink as described above, there are also provided two pressure chambers for the black ink. Further, there are provided two arrays of individual electrodes 44 corresponding to the pressure chambers 30 for the black ink. Thus, as shown in FIG. 9, there are two arrays of land arrays 53 formed of the lands 47 corresponding to the bumps 45 associated with the discharge of the black ink. The land array 53 of the above embodiment (the land array, of the two land arrays 53 associated with the discharge of the black ink, disposed at the outside) is related only to the discharge of the black ink for the text printing. Therefore, the frequency of the usage of this land array 53 is smaller than that of the other land array 53. Noted that, by arranging the land array 53 (nozzle array) having the high frequency of the usage close to the center, it is possible to reduce a moving distance of the carriage 2 at the time of the reciprocating scanning in low-resolution printing by a distance corresponding to one land array 53 (nozzle array).

A plurality of dummy wiring lines 60 (eight dummy wiring lines in this embodiment) positioned around each of the land arrays 53 each include a first portion extending in a left-right direction perpendicular to the transport direction on any one of the sides (rear side in this embodiment) of the land arrays 53. Further, the dummy wiring lines 60 each include a pair of second portions extending in the transport direction while sandwiching each of the land arrays 53 from the both end portions of the first portion. Dummy wiring lines 61 extend in the transport direction. These constructions as described above are the same as those of the above embodiment. The dummy wiring lines 61 have a common area 61*a* in which the end portion on the side of the driver IC 49 is made common or communalized. The common area 61*a* is formed so that the dummy wiring lines 61 disposed to be adjacent to each other are brought in contact with each other. In other words, the dummy wiring lines 61 disposed to be adjacent to each other are formed as terminals which are coupled to each other to spread planarly. Thus, as compared with an area in which the dummy wiring lines 61 are formed independently, the area of the conductive material is larger. The common area 61*a* functions as an example of a heat radiating member. The common areas 61*a* radiate heat around the lands 47, and thereby decreasing temperature around the lands 47.

In a case that the ink-jet printer is used by a user, recording by the black ink is performed more often than recording by the color inks (cyan ink, magenta ink, and yellow ink). Thus, frequency of usage of the lands 47 associated with the discharge of the black ink is also higher than frequencies of usage of the lands 47 associated with the discharge of the color inks. Thus, the temperature around the land arrays 53, which are related with the discharge of the black ink in both of the low-resolution printing and the high-resolution printing, is highest. Then, in order to decrease the temperature by heat radiation, a length L1 of the common area 61*a* of the dummy wiring lines 61 around the land array 53, which is related to the discharge of the black ink in both of the low-resolution printing and the high-resolution printing, is longer than lengths L2 and L3 of other common areas 61*a*. Further, in case that the signal wiring lines 48 from the driver IC 49 to the lands 47 are short, the lands 47 each have a high temperature; and in case that the signal wiring lines 48 from the driver IC 49 to the lands 47 are long, the lands 47 each have a low temperature. Thus, the length L3 of the common areas 61*a* around the land arrays 53 disposed on both ends is shorter than lengths L1 and L2 of other common areas 61*a*. The common areas 61*a* around the land arrays 53 positioned on the central side each have the length L2. A relation between the lengths L1 to L3 satisfies L1>L2>L3. The reason why the temperature of each land 47 increases is that the heat from the driver IC 49 is conducted to the lands 47 via the signal wiring lines 48. The amount of heat conducted to each land 47 increases, as the length of each signal wiring line 48 is shorter, and thus the temperature of each land 47 increases.

In the above description, one modified embodiment of the above embodiment has been described based on the drawings. Hereinafter, still other modified embodiments will be described. In the above embodiment, each of the dummy wiring lines 55 includes the first portion 55*a* extending in the left-right direction perpendicular to the transport direction on any one of the sides (rear side in this embodiment) of each of the land arrays 53. Further, each of the dummy wiring lines 55 includes the pair of second portions 55*b* extending in the transport direction while sandwiching each of the land arrays 53 from the both end portions of the first portion 55*a*. The present teaching, however, is not limited thereto, and all of the dummy wiring lines may extend in the left-right direction perpendicular to the transport direction. Alternatively, all of the dummy wiring lines may extend in the transport direction.

In the above embodiment, for each of the dummy wiring lines 55, the second portions 55*b* extend in the transport direction while sandwiching each of the land arrays 53 from the both end portions of the first portion 55*a*. The present teaching, however, is not limited thereto, and the second portions 55*b* may extend in the transport direction from the intermediate portion of the first portion 55*a*. Further, he second portions 55*b* may not be formed as the pair, and any one of the second portions 55*b* may be formed (single second portion 55*b* may be formed).

In the above embodiment, for the dummy wiring lines 55, the spacing distance T1, between adjacent first portions 55*a*, in which no dummy wiring line 55 is formed is larger than the spacing distance t2, between adjacent second portions 55*b*, in which no dummy wiring line 55 is formed. The present teaching, however, is not limited thereto, and the spacing distance t2 may be greater than the spacing distance t1. Further, the spacing distance t1 may be equal to the spacing distance t2.

In the above embodiment, the spacing distance t2 between adjacent second portions 55*b*, in which no dummy wiring line 55 is formed is equal to the spacing distance, between adjacent signal wiring lines 48, in which no signal wiring line 48 is formed. The present teaching, however, is not limited thereto, and the spacing distance t2 may not be equal to the spacing distance, between adjacent signal wiring lines 48, in which no signal wiring line 48 is formed.

In the above embodiment, for the dummy wiring lines 55, the width w1 of each first portion 55*a* is larger than the width w2 of each second portion 55*b*. The present teaching, however, is not limited thereto, and the width w2 may be larger than the width w1. Alternatively, the width w1 may be equal to the width w2.

In the above embodiment, there are provided a plurality of dummy wiring lines 55 and 56. However, a single dummy wiring line may be provided. For example, one dummy wiring line having a substantially rectangular shape may be formed to surround the four land arrays 53 entirely. Further, one dummy wiring line having the substantially rectangular shape may be formed to surround one of the land arrays 53, so that four dummy wiring lines surround four land arrays 53, respectively.

In the above embodiment, the ink-jet head 3 is an ink-jet head of a piezoelectric type in which the jetting energy is applied to the ink by the piezoelectric actuator 22 as the energy applying device applying jetting energy to the ink. The present teaching, however, is not limited thereto. For example, the ink-jet head 3 may be an ink-jet head of a thermal type in which the jetting energy is applied to the ink by performing heating with a heating apparatus. In a case of the ink-jet head of the thermal type, there is fear that the potting is melted due to the heating of the heating apparatus, and thereby decreasing sealing ability between the heating apparatus and the wiring board.

In the above embodiment, the FPC 23 is arranged to face the piezoelectric actuator 22 such that the FPC 23 covers one of the surfaces of the piezoelectric actuator 22, that is, the entire upper surface of the piezoelectric actuator 22. The present teaching, however, is not limited thereto, and the FPC 23 may be arranged to face the piezoelectric actuator 22 such that the FPC 23 covers a part of one surface of the piezoelectric actuator 22.

In the above embodiment, the potting 54 overlaps with a part of the dummy wiring lines 56. The present teaching, however, is not limited thereto, and the following construction is also allowable. That is, the dummy wiring lines 55, 56 are formed between the arrangement area of the lands 47 and the areas M1, M2 in which the potting 54 is positioned, so that the potting 54 does not overlap with the dummy wiring lines 55, 56. Alternatively, the dummy wiring lines 55, 56 may overlap entirely with the potting 54. It is noted that although the potting 54 is injected along the edge of the piezoelectric actuator 22 such that the potting 54 does not overlap with and surrounds the dummy wiring lines 55, 56, the potting 54 overlaps with a part of dummy wiring lines 55, 56 or overlaps entirely with the dummy wiring lines 55, 56 when flowing inside.

In the above embodiment, the potting 54 is injected into the area surrounding the arrangement area of the bumps 45 and the lands 47, in particular, along the entire circumference of the edge of the piezoelectric actuator 22. The present teaching, however, is not limited thereto, and the potting 54 may be injected along a part of the circumference of the edge of the piezoelectric actuator 22. Alternatively, the potting 54 may not be arranged along the edge of the piezoelectric actuator 22, provided that the area into which the potting 54 is injected surrounds the arrangement area of the bumps 45 and the lands 47. For example, the potting 54 may be arranged at the inside of the edge.

In the above embodiment, the dummy wiring lines are formed between the arrangement area of the lands and the area in which the potting is positioned. The present teaching, however, is not limited thereto. Instead of each dummy wiling line made of the conductive material (wiring material), it is allowable to form, for example, a recess portion (groove) and/or a protrusion portion (convexity) (in the present description, the recess portion and/or the protrusion portion is/are referred to as a recess-protrusion portion). Also in a case in which the recess-protrusion portion is formed, on the FPC 23, between the arrangement area of the lands and the area in which the potting is positioned, the injected potting 54 can be prevented from penetrating or entering to the bumps 45 and the lands 47. It is noted that the recess-protrusion portion can be formed by a screen printing method and the like.

What is claimed is:

1. A liquid droplet jetting apparatus configured to jet liquid droplets of a liquid, comprising:

a channel structure in which a liquid channel including a plurality of nozzles is formed;

an energy applying device which is configured to apply jetting energy for jetting the liquid droplets from the nozzles to the liquid in the liquid channel, and includes a plurality of first contact points disposed on a surface of the energy applying device;

a wiring board arranged to face the surface of the energy applying device and connected to the energy applying device, including:

a plurality of second contact points electrically connected to the first contact points of the energy applying device, respectively; and a plurality of signal wiring lines connected to the second contact points, respectively;

a sealing material arranged, between the wiring board and the energy applying device, to surround at least a part of an area, of the wiring board, in which the first contact points and the second contact points are arranged; and a recess-protrusion portion formed in an area, of the wiring board, which is positioned between the sealing material and the second contact points and which includes at least one of a recessed portion and a protrusion portion;

wherein the recess-protrusion portion is formed at least in part by a dummy wiring line which is not electrically connected to the second contact points and which protrudes toward the energy applying device;

wherein the second contact points form a contact point array arranged in a first direction; and wherein the dummy wiring line includes:

a first portion extending in a second direction intersecting the first direction at any one side in the first direction in which the contact point array extends; and a pair of second portions extending from the first portion along the first direction while sandwiching the contact point array.

2. The liquid droplet jetting apparatus according to claim 1;

wherein the dummy wiring line is formed to extend along the area in which the second contact points are arranged.

3. The liquid droplet jetting apparatus according to claim 2;

wherein the second contact points form a contact point array arranged in a first direction; and the dummy wiring line includes a first dummy wiring line extending in a second direction intersecting the first direction and a second dummy wiring line extending in the first direction.

4. The liquid droplet jetting apparatus according to claim 1;

wherein the dummy wiring line is formed as a plurality of dummy wiring lines; and a spacing distance, between a plurality of first portions disposed to be adjacent to each other, in which no dummy wiring line is formed is greater than a spacing distance, between a plurality of second portions disposed to be adjacent to each other, in which no dummy wiring line is formed.

5. The liquid droplet jetting apparatus according to claim 4;

wherein the signal wiring lines extend in the first direction; and the spacing distance, between the adjacent second portions, in which no dummy wiring line is formed is equal to a spacing distance, between adjacent signal wiring lines, in which no signal wiring line is formed.

6. The liquid droplet jetting apparatus according to claim 4;

wherein a width of the first portion is greater than a width of the second portion in each of the dummy wiring lines.

7. The liquid droplet jetting apparatus according to claim 3;

wherein the second contact points form the contact point array arranged in the first direction;

the dummy wiring line includes a plurality of first dummy wiring lines extending in the second direction intersecting the first direction; and a plurality of second dummy wiring lines extending in the first direction; and a spacing distance between the first dummy wiring lines disposed to be adjacent to each other is larger than a spacing distance between the second dummy wiring lines disposed to be adjacent to each other.

8. The liquid droplet jetting apparatus according to claim 7;

wherein the signal wiring lines extend along the first direction; and the spacing distance between the second dummy wiring lines disposed to be adjacent to each other is equal to a spacing distance between the signal wiring lines disposed to be adjacent to each other.

9. The liquid droplet jetting apparatus according to claim 7;

wherein a width of each of the first dummy wiring lines is larger than a width of each of the second dummy wiring lines.

10. The liquid droplet jetting apparatus according to claim 3;

wherein the first dummy wiring line is connected to one of the second dummy wiring lines.

11. The liquid droplet jetting apparatus according to claim 3;

wherein the first dummy wiring line is insulated from all of the second dummy wiring lines.

12. The liquid droplet jetting apparatus according to claim 1;

wherein a portion, of the dummy wiring line, forming the first portion is connected to a portion, of the dummy wiring line, forming the second portion.

13. The liquid droplet jetting apparatus according to claim 1;

wherein a portion, of the dummy wiring line, forming the first portion is insulated from a portion, of the dummy wiring line, forming the second portion.

14. The liquid droplet jetting apparatus according to claim 1, wherein the dummy wiring line is formed as a plurality of dummy wiring lines; and wherein a spacing distance between two adjacent dummy wiring lines of the plurality of dummy wiring lines is greater than a width of the two adjacent dummy wiring lines.

15. The liquid droplet jetting apparatus according to claim 1;

wherein the plurality of signal wiring lines extend from the one side to the other side in the first direction; and wherein the sealing material is arranged to surround the contact point array and the dummy wiring line such that the sealing material is placed on the plurality of signal wiring lines to cross the plurality of signal wiring lines at the other side in the first direction.

16. The liquid droplet jetting apparatus according to claim 1;

wherein the dummy wiring line is arranged to surround the plurality of second contact points;

wherein a plurality of through holes are formed in the wiring board at an area surrounded by the dummy wiring line; and wherein each the plurality of signal wiring lines includes a first connecting portion arranged on one surface of the wiring board and connecting one of the second contact points and one of the through holes, a second connecting portion connecting both openings of the one of the through holes, and a third connecting portion arranged on the other surface of the wiring board to cross the sealing material with sandwiching the wiring board between the third connecting portion and the sealing material.

17. The liquid droplet jetting apparatus according to claim 16;

wherein the third connecting portion arranged on the other surface of the wiring board is electrically connected to the energy applying device which is located to face the other surface of the wiring board.

* * * * *